US011117598B2

(12) United States Patent
Jones et al.

(10) Patent No.: US 11,117,598 B2
(45) Date of Patent: Sep. 14, 2021

(54) AUTO-RACK RAILROAD CAR

(71) Applicant: Gunderson LLC, Portland, OR (US)

(72) Inventors: Peter L. Jones, Southlake, TX (US); Victor Mankarious, Euless, TX (US)

(73) Assignee: Gunderson LLC, Portland, OR (US)

( * ) Notice: Subject to any disclaimer, the term of this patent is extended or adjusted under 35 U.S.C. 154(b) by 267 days.

(21) Appl. No.: 16/294,236

(22) Filed: Mar. 6, 2019

(65) Prior Publication Data

US 2020/0283033 A1 Sep. 10, 2020

(51) Int. Cl.
*B61D 3/04* (2006.01)
*B61D 3/18* (2006.01)
*B61D 3/02* (2006.01)

(52) U.S. Cl.
CPC ..... *B61D 3/187* (2013.01); *B61D 3/02* (2013.01); *B61D 3/04* (2013.01)

(58) Field of Classification Search
CPC ..... B61D 3/187; B61D 3/04; B61D 3/005; B61D 3/02; B60P 3/08; B60P 3/07; B62D 33/0207
See application file for complete search history.

(56) References Cited

U.S. PATENT DOCUMENTS 3,604,369 A * 9/1971 Maslow ..... A47B 57/265 108/147.13
3,851,600 A * 12/1974 Kohl ..... F16B 2/06 108/147.14
4,138,953 A * 2/1979 Tashman ..... A47B 57/265 108/147.13
4,811,670 A * 3/1989 Kolvites ..... A47B 57/265 108/107
5,338,137 A * 8/1994 Jensen ..... B60P 7/06 211/187
5,685,228 A 11/1997 Ehrlich et al.
5,743,192 A 4/1998 Saxton et al.
5,794,537 A 8/1998 Zaerr et al.
5,979,335 A 11/1999 Saxton et al.
6,059,075 A 5/2000 Saxton et al.
6,138,579 A 10/2000 Khattab
6,325,579 B1 12/2001 Jarvis
7,055,441 B2 6/2006 Jarvis
7,546,808 B2 6/2009 Saxton et al.
8,016,140 B2 * 9/2011 Hsieh ..... A47B 57/482 211/187
8,622,355 B2 * 1/2014 Pryor ..... A47B 9/14 248/188.5
9,061,687 B2 6/2015 Zaerr
10,377,392 B2 8/2019 Bis et al.
10,576,998 B2 3/2020 Coston et al.
2006/0219129 A1 10/2006 Jarvis
2008/0141897 A1 6/2008 Zaerr
2015/0284012 A1 10/2015 Zaerr
2016/0039432 A1 2/2016 Cencer et al.
2017/0217452 A1 8/2017 Huck et al.
2018/0015934 A1 1/2018 Bis et al.
2018/0118229 A1 5/2018 Huck et al.

* cited by examiner

*Primary Examiner* — Mark T Le
(74) *Attorney, Agent, or Firm* — Neal, Gerber & Eisenberg LLP

(57) ABSTRACT

An auto-rack railroad car including a frame, a plurality of upright posts supported by the frame, a deck, and a plurality of deck connector assemblies connecting the deck to the upright posts, each deck connector assembly including at least one wedge.

25 Claims, 14 Drawing Sheets

AUTO-RACK RAILROAD CAR

BACKGROUND

The railroad industry employs a variety of auto-rack railroad cars for transporting vehicles (such as automobiles, vans, and trucks). Auto-rack railroad cars, known in the railroad industry as auto-rack cars, often travel thousands of miles through varying terrain. Various types of auto-rack cars are compartmented, having two or three decks, two side walls, a pair of doors at each end, and a roof. Newly manufactured vehicles are typically loaded into (and unloaded from) an auto-rack car by people who respectively drive the vehicles into or out of the auto-rack car on the respective decks. There is a continuing need to provide improved auto-rack cars for the railroad industry, such as the efficient conversion from bi-level to tri-level deck configuration and vice versa, which currently has to be done in a rail car maintenance facility.

SUMMARY

Various embodiments of the present disclosure provide improved auto-rack railroad cars (such as a bi-level or tri-level auto-rack railroad cars), deck connection assemblies for auto-rack railroad cars, improved methods of manufacturing auto-rack railroad cars, and improved methods of repositioning decks of auto-rack railroad cars.

Various example embodiments of the present disclosure provide an auto-rack car including a frame, a plurality of the upright posts attached to the frame, and a deck attached to the upright posts by a plurality of deck connector assemblies. In such example embodiments, each deck connector assembly includes one or more wedges connected to one of the upright posts, one or more wedge engagement brackets connected to the deck and configured to engage the wedge (s), and one or more post clamping bracket connected to the deck and configured to engage the upright post. The deck connector assemblies are configured to facilitate attachment of the deck to the upright posts.

Various example embodiments of the present disclosure provide a method of manufacturing an auto-rack car including, for each deck connector assembly and each respective upright post: (1) attaching the wedge engagement and post clamping brackets of the deck connector assembly to the deck; and (2) attaching the wedges of the deck connector assembly to the upright post. The method thereafter further includes lowering the deck such that the wedge engagement and post clamping brackets of the respective deck connection assemblies engage the wedges attached to the respective upright posts and the respective upright post to securely attach the deck to the upright posts.

Other objects, features, and advantages of the present disclosure will be apparent from the following detailed disclosure, taken in conjunction with the accompanying sheets of drawings, wherein like reference numerals refer to like parts.

DETAILED DESCRIPTION

Figure 1:
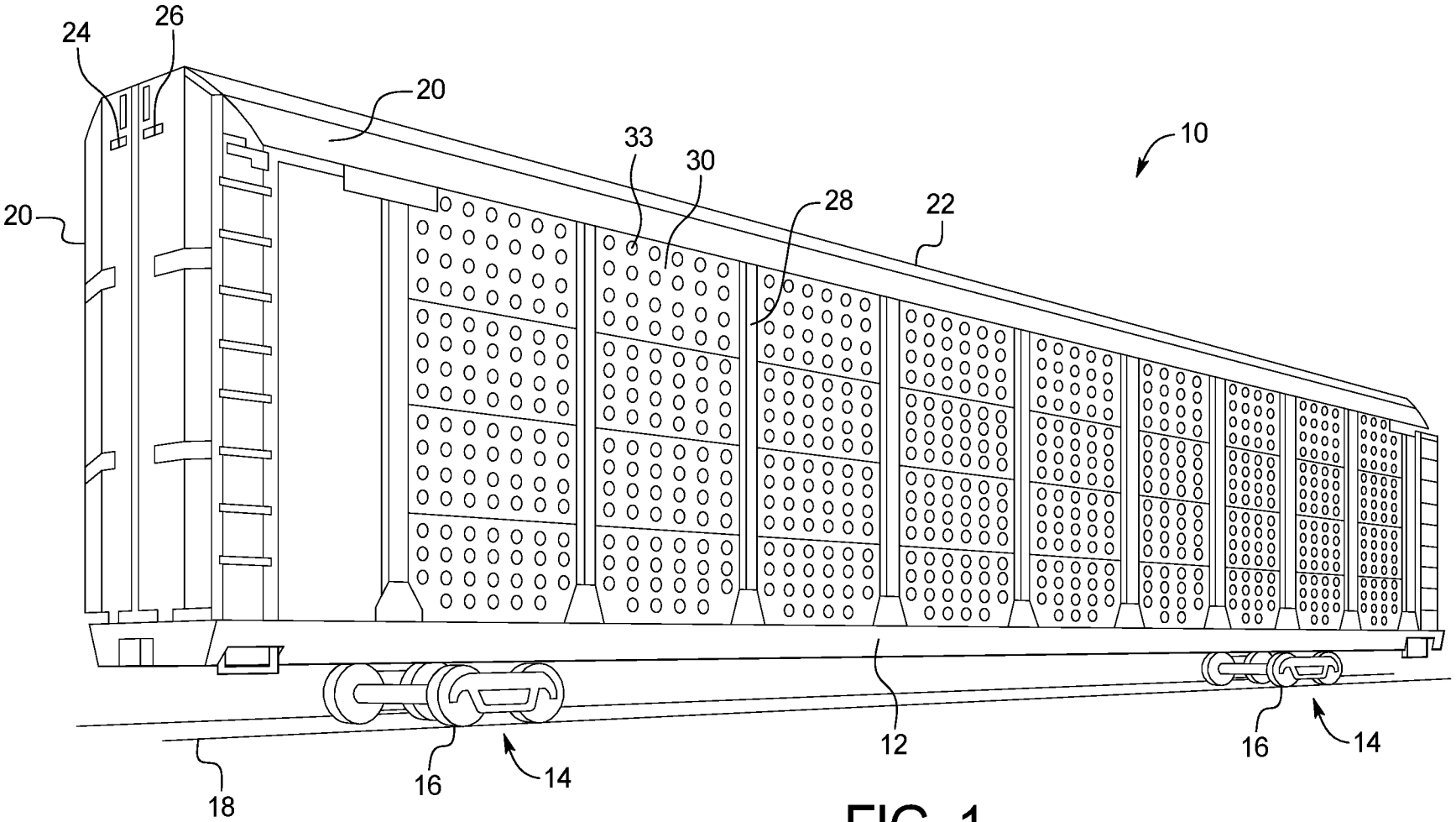
FIG. 1 is a perspective diagrammatic view of an example auto-rack railroad car of the present disclosure that is configured to transport a plurality of vehicles.

While the features, devices, and apparatus described herein may be embodied in various forms, the drawings show and the specification describe certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as coupled, mounted, connected, and the like, are not intended to be limited to direct mounting methods but should be interpreted broadly to include indirect and operably coupled, mounted, connected and like mounting methods. This specification is intended to be taken as a whole and interpreted in accordance with the principles of the present disclosure and as understood by one of ordinary skill in the art.

Referring now to the drawings and particularly to FIG. 1, an example auto-rack car is generally illustrated and indicated by numeral 10. This illustrated example auto-rack car 10 includes a frame 12 supported by trucks 14, each of which have several wheels 16 configured to roll along railroad tracks 18. The frame 12 supports two spaced-apart side walls 20 and a roof 22. The auto-rack car 10 includes a pair of co-acting tri-fold doors 24 and 26 mounted on each end of the auto-rack car 10. Each set of doors 24 and 26 are openable to facilitate the loading and unloading of vehicles into and out of the auto-rack car 10 (and are configured to be closed during transport and storage of the vehicles). It should be appreciated that the present disclosure contemplates that the auto-rack car can be otherwise configured such as with different types of doors or other components.

In this illustrated example embodiment, the side walls 20 each include a series of steel upright posts 28 that are mounted on, and extend upwardly from, the frame 12. The roof 22 is mounted on and supported by these upright posts 28. The upright posts 28 are spaced along the entire length of both side walls 20 of the auto-rack car 10. A plurality of rectangular galvanized steel side wall panels 30 that generally extend horizontally and are vertically spaced apart are mounted between various pairs of upright posts 28. These side wall panels 30 are supported at their corners by brackets (not shown) that are suitably secured to the respective upright posts 28. Each side wall panel 30 has a multiplicity of round side wall panel holes 33. These side wall panel holes 33 provide the auto-rack car 10 with natural light as well as proper ventilation. Proper ventilation prevents harm from the toxic vehicle fumes to the loaders loading or unloading the vehicles into or out of the auto-rack car 10. The auto-rack car 10 in this illustrated example embodiment is a bi-level auto-rack car having a first deck (not shown) and a second deck 50.

Figure 2:
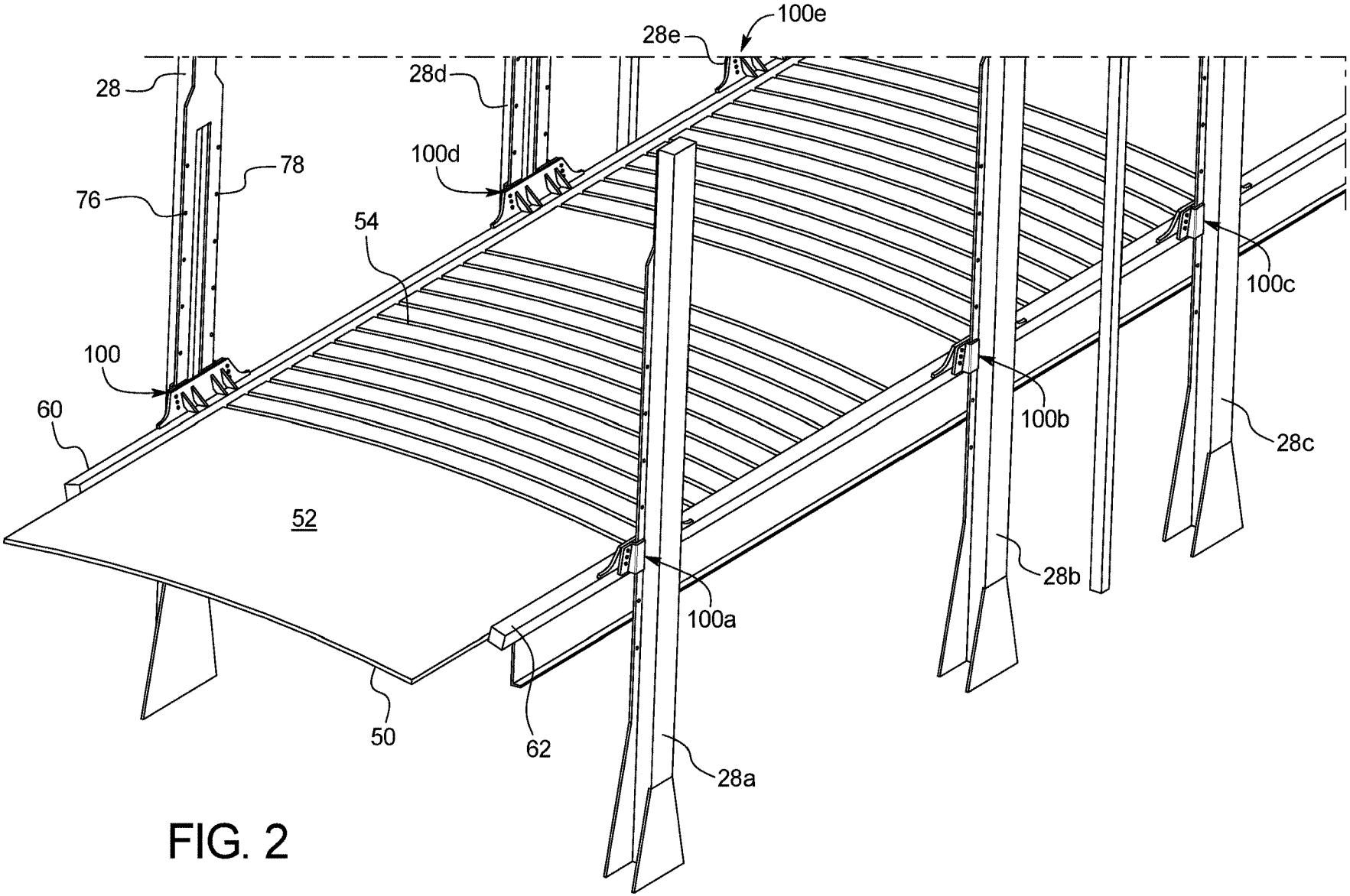
FIG. 2 is a fragmentary perspective interior view of one of the decks of the example auto-rack railroad car of FIG. 1 attached to a plurality of upright post of the auto-rack railroad car of FIG. 1 by a plurality of deck connector assemblies of the auto-rack railroad car of FIG. 1.

Referring now to FIG. 2, certain components of the auto-rack car 10 are shown. Particularly, FIG. 2 shows of a portion of the deck 50 of the auto-rack car 10 attached to a plurality of example upright posts of the auto-rack car 10 and particularly to upright posts 28, 28*a*, 28*b*, 28*c*, 28*d*, and 28*e* of the auto-rack railroad car 10 by a plurality of example deck connector assemblies 100, 100*a*, 100*b*, 100*c*, 100*d*, and 100*e* of the present disclosure. The deck 50, the upright posts (such as upright posts 28, 28*a*, 28*b*, 28*c*, 28*d*, and 28*e*) and the deck connector assemblies 100, 100*a*, 100*b*, 100*c*, 100*d*, and 100*e* are configured to facilitate part of the manufacture of the auto-rack car 10, and specifically, connection of the deck 50 to the upright posts 28, 28*a*, 28*b*, 28*c*, 28*d*, and 28*e* via the plurality of deck connector assemblies 100, 100*a*, 100*b*, 100*c*, 100*d*, and 100*e* as further described herein.

As also further explained below, the present disclosure provides a method of manufacturing an auto-rack car that generally includes, for each respective deck connector assembly and each respective upright post: (1) attaching brackets of the deck connector assembly to the deck; (2) attaching wedges of the deck connector assembly to the upright post; and (3) lowering the deck such that the brackets of the deck connection assembly engage the upright post and the wedges attached to the upright post. The resulting connection between the deck (via the brackets and the wedges) and the upright posts: (1) rigidly attaches the deck to the upright posts; (2) substantially prevents outward lateral movement of the upright posts relative to the deck; and (3) substantially prevents inward lateral movement of the upright posts relative to the deck. The present disclosure also eliminates the use of various bolts to locate and secure the deck to the upright posts Additionally, it should be appreciated that when cargo weight (such as vehicles or other goods being shipped) is loaded onto the attached deck, the additional weight tightens the connection between the deck and the upright posts.

The deck connection assemblies present of the present disclosure therefore generally provide: (1) a strong connection between the deck and the upright posts; (2) structural support for the entire auto-rack car; (3) a relatively quick manufacturing process for attaching decks to upright posts; and (4) a quick and simple adjustment of deck height(s) for different size manufactured vehicles between trips by a single person and without the need to send the auto-rack car to a rail car maintenance facility. The deck connection assemblies also reduces out of service time for operators of the auto-rack car.

It should further be appreciated that the present disclosure thus contemplates: (1) new railroad cars; (2) new deck connections assemblies; (3) new methods of manufacturing railroad cars; (4) new methods of reconfiguring decks railroad cars; and (5) elimination of various bolts to locate and secure the deck to the upright posts.

Referring now to FIGS. 3, 4, 5, 6, 7, 8, 9, 10, 11, 12, 13, and 14, in this illustrated example embodiment, the deck connector assembly 100 of the auto-rack car 10 is shown connecting the deck 50 to the upright post 28. FIGS. 3, 4, 5, 6, 7 also show how part of the deck connector assembly 100 is connected to the deck 50 and how part of the deck connector assembly 100 is connected to the upright post 28.

More specifically, in this illustrated example embodiment, the deck 50 generally includes: (1) a central portion 52, (2) a first longitudinally extending member 60, and (3) a second longitudinally extending member 62. In this example embodiment of the present disclosure, the deck 50 is made from steel; however, it should be appreciated that the deck can be made from other suitably strong materials in accordance with the present disclosure. It should also be appreciated that the deck can be otherwise suitably sized and configured in accordance with the present disclosure.

The central portion 52 extends along the length of the auto-rack railroad car 10 between the plurality of upright posts 28, 28*a*, 28*b*, 28*c*, 28*d*, and 28*e*. The central portion 52 defines a plurality of grooves 54 oriented transverse to the longitudinal direction of the auto-rack railroad car 10. The grooves 54 are positioned in groups, such that the central portion 52 has a first area defining grooves 54 spaced apart from a second area defining additional grooves 54. The entire deck 50 or at least the central portion 52 of the deck 50 includes a slight lateral curvature (e.g., is convex from the top), such that the central portion 52 extends slightly downward toward the outer edges of the central portion from a relatively higher center line.

Figure 5:
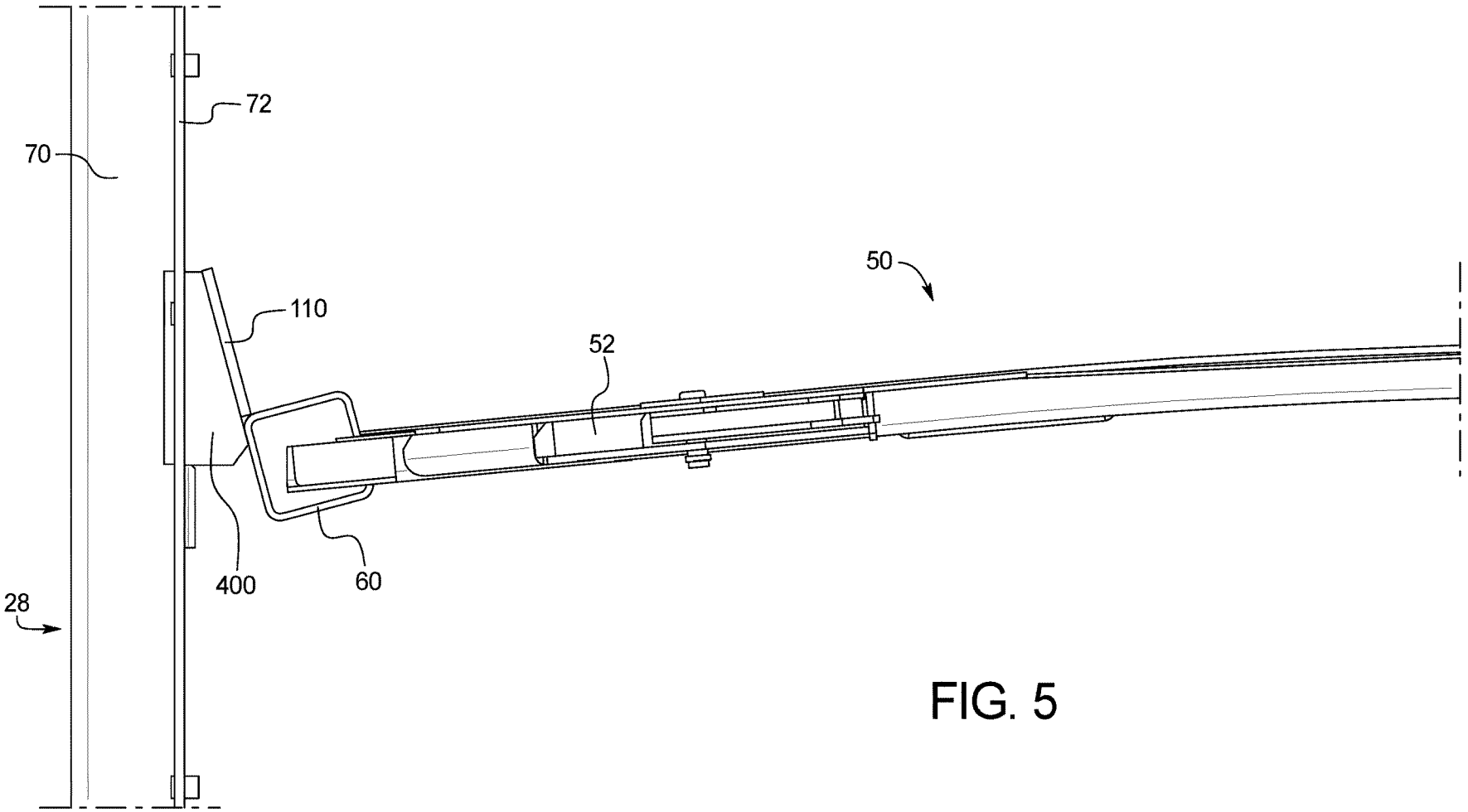
FIG. 5 is an enlarged fragmentary end view of part of the deck of FIG. 3 attached to the upright post of FIG. 3 by the deck connector assembly of FIG. 3.

The first longitudinally extending member 60 is fixed to the central portion 52 along the length of a first edge of the central portion 52. FIG. 5 illustrates an expanded view of the coupling between the central portion 52 and the first longitudinally extending member 60. The central portion 52 may be inserted into an opening in the first longitudinally extending member 60, and may be welded into place to prevent movement.

The second longitudinally extending member 62 mirrors the first longitudinally extending member 60. The second longitudinally extending member 62 is fixed to the central portion 52 along the length of a second edge of the central portion 52. The central portion 52 may be inserted into an opening in the second longitudinally extending member 62, and may be welded into place to prevent movement.

In this illustrated example embodiment, the upright post 28 includes: (1) a center upright member 70, (2) an upright first flange 72, and (3) an upright second flange 74. In this example embodiment of the present disclosure, the upright post 28 (as well as the other upright posts and the frame) are made from steel; however, it should be appreciated that one or more of these components can be made from other suitably strong materials in accordance with the present disclosure. It should also be appreciated that the upright posts can be otherwise suitably sized, shaped, and configured in accordance with the present disclosure.

The center member 70 has a rectangular cross section, and extends upward from the frame 12 of the auto-rack railroad car 10. The first flange 72 extends vertically upward along an edge of the center vertical member 70. The first flange 72 defines a plurality of vertically spaced apart wedge attachment apertures 76. The second flange 74 extends vertically upward along a second edge of the center vertical member 70. The second flange 74 defines a plurality of vertically spaced apart wedge attachment apertures 78. The apertures 76 are aligned horizontally with the apertures 78.

In this illustrated example embodiment, the deck connector assembly 100 includes: (1) a wedge engagement bracket 110 connected to the deck 50; (2) a first post clamping bracket 200 connected to the wedge engagement bracket 110; (3) a second post clamping bracket 300 connected to the wedge engagement bracket 110; (4) a first wedge 400 connected to the upright post 28; and (5) a second wedge 500 connected to the upright post 28. In this example embodiment of the present disclosure, the brackets of the deck connection assembly 100 are each made from steel; however, it should be appreciated that one or more of these brackets can be made from other suitably strong materials in accordance with the present disclosure. In this example embodiment of the present disclosure, the wedges 400 and 500 are made from case hardened steel; however, it should be appreciated that one or more of the wedges can be made from other suitably strong materials in accordance with the present disclosure. It should also be appreciated that the brackets, components or features of the brackets, and wedges can be otherwise suitably sized, shaped, and configured in accordance with the present disclosure In this illustrated example embodiment, the wedge engagement bracket 110 includes a generally flat wedge engagement plate having a first surface 112 and a second surface 114. The wedge engagement bracket 110 is generally trapezoidal in shape, having a narrower top edge 116 and a wider bottom edge 118. The wedge engagement bracket 110 spans transversely across the upright post 28, extending beyond both the first flange 72 and the second flange 74. The wedge engagement bracket 110 is angled with respect to vertical (i.e., 90 degrees) when in use. The angle with respect to vertical can vary from 5-45 degrees in various embodiments depending on the angle of the first wedge 400 and the second wedge 500. This is best shown in FIG. 5.

In this illustrated example embodiment, the bottom edge 118 of the wedge engagement bracket 110 is fixed to the first longitudinally extending member 60 of the deck 50 by welding. The wedge engagement bracket 110 also includes a plurality of trapezoidal securing plates 120*a*, 120*b*, 120*c*, and 120*d* fixed to the first surface 112 of the wedge engagement bracket 110 via a first edge, and to the first longitudinally extending member 60 via a second edge.

Figure 3:
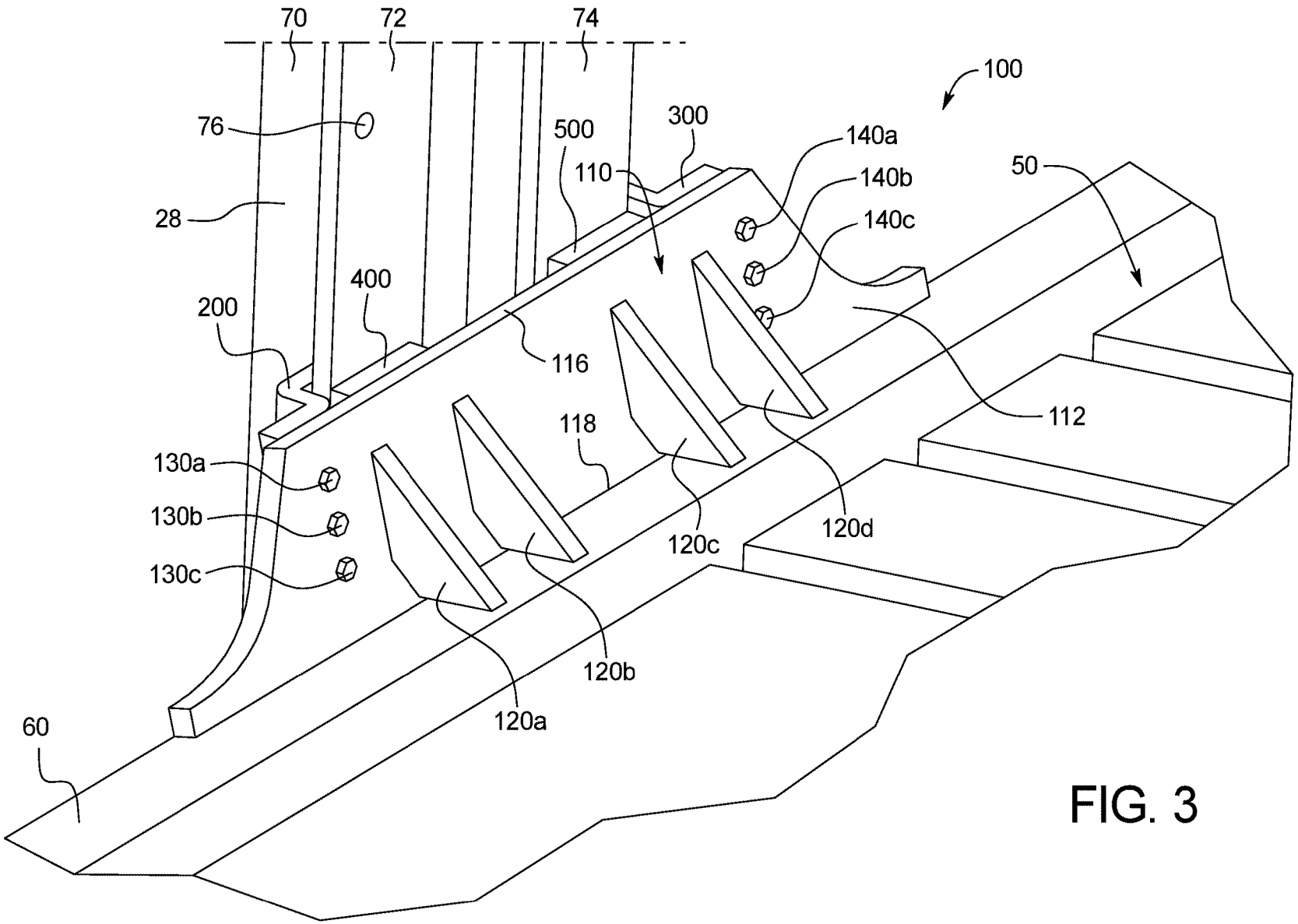
FIG. 3 is an enlarged fragmentary perspective interior view of part of the deck of FIG. 2 attached to one of the upright posts of FIG. 2 by one of the deck connector assemblies of FIG. 2.
Figure 4:
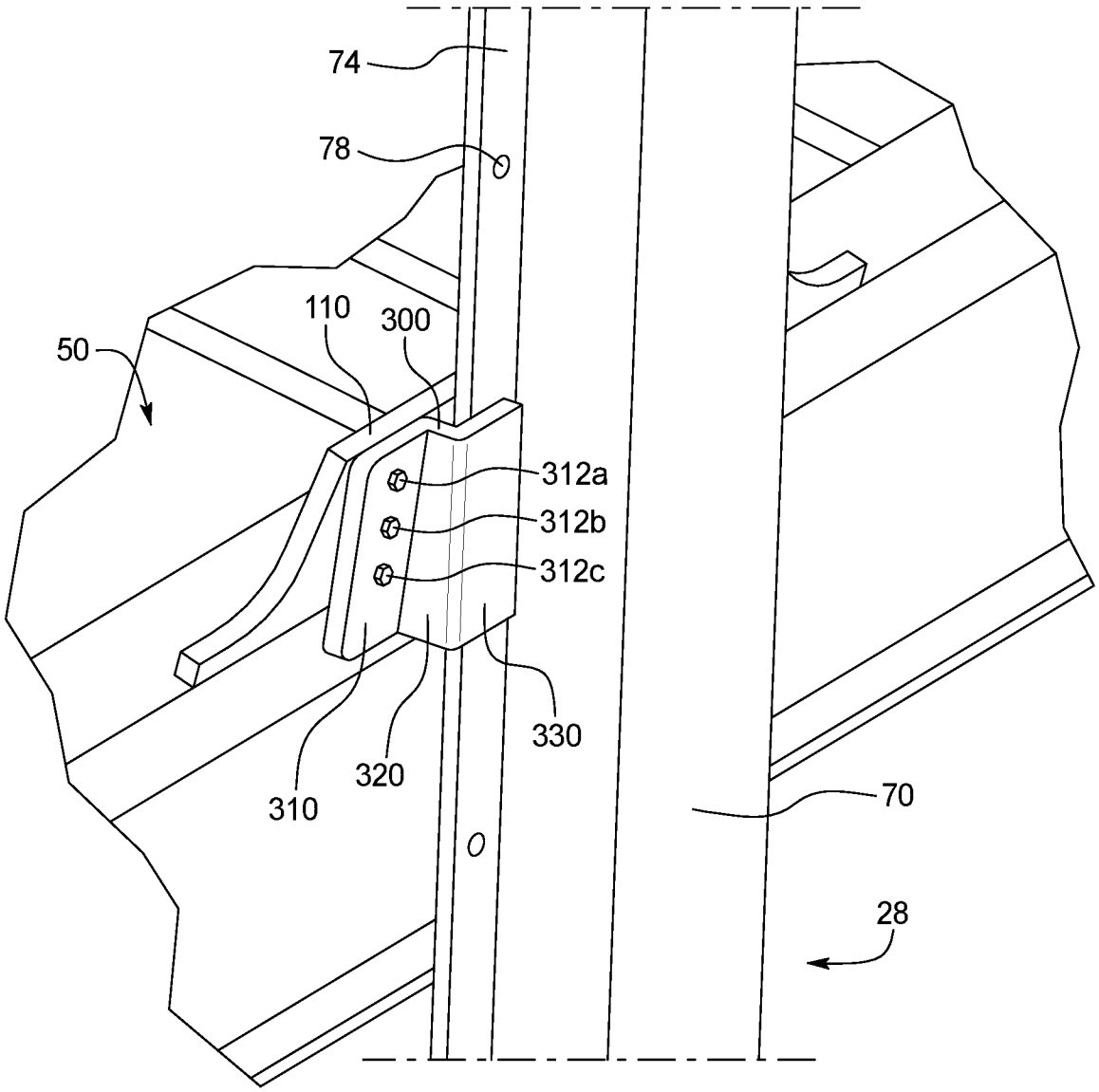
FIG. 4 is an enlarged fragmentary perspective exterior view of part of the deck of FIG. 3 attached to the upright post of FIG. 3 by the deck connector assembly of FIG. 3.
Figure 6:
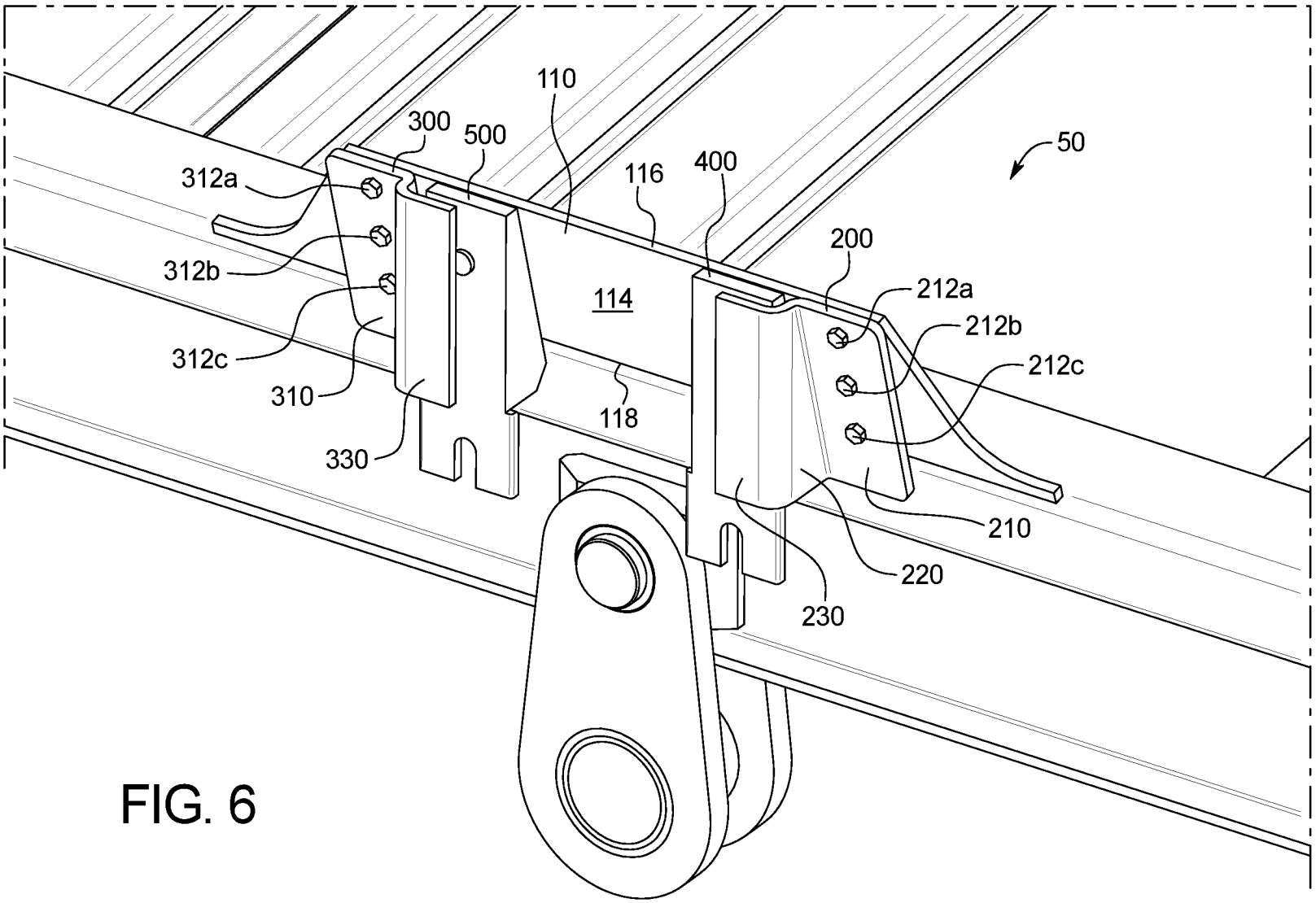
FIG. 6 is an enlarged fragmentary perspective exterior view of the deck connector assembly of FIG. 3 with part of the deck connector assembly attached to part of the deck of FIG. 3.
Figure 7:
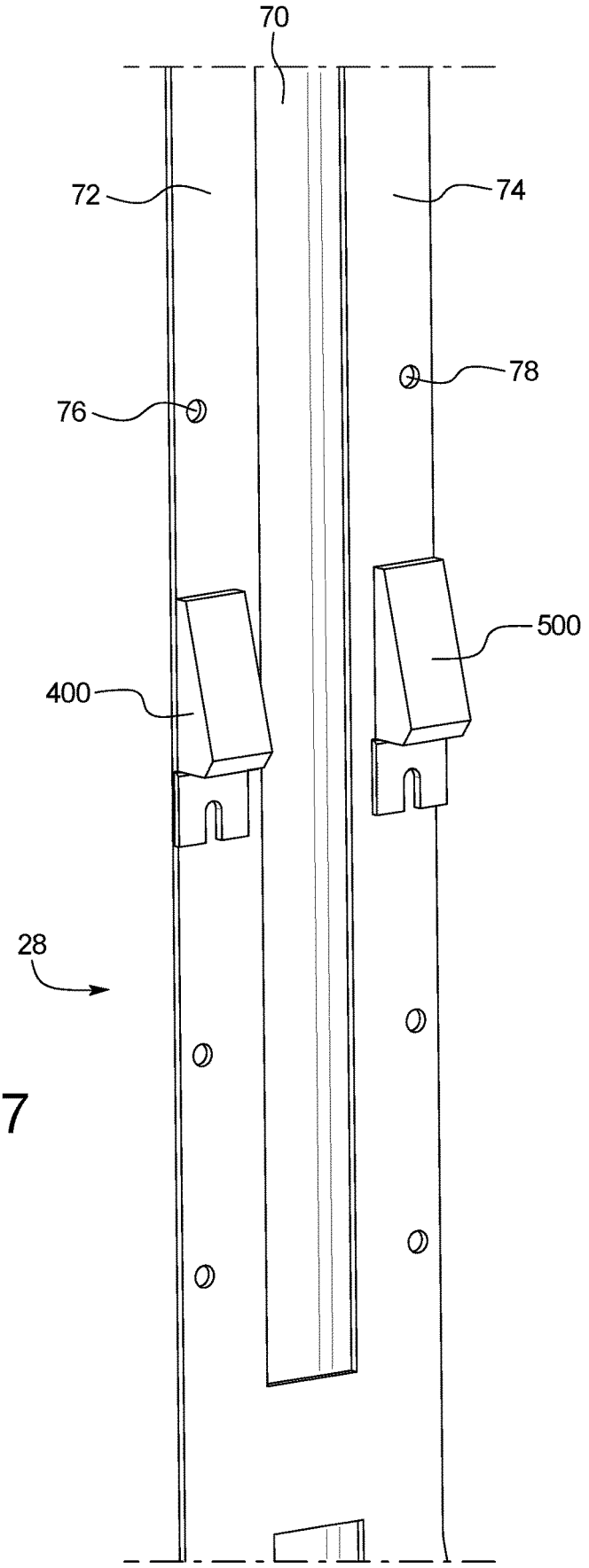
FIG. 7 is an enlarged fragmentary perspective interior view of the wedges of the deck connector assembly of FIG. 3 attached to the upright post of FIG. 3.
Figure 8:
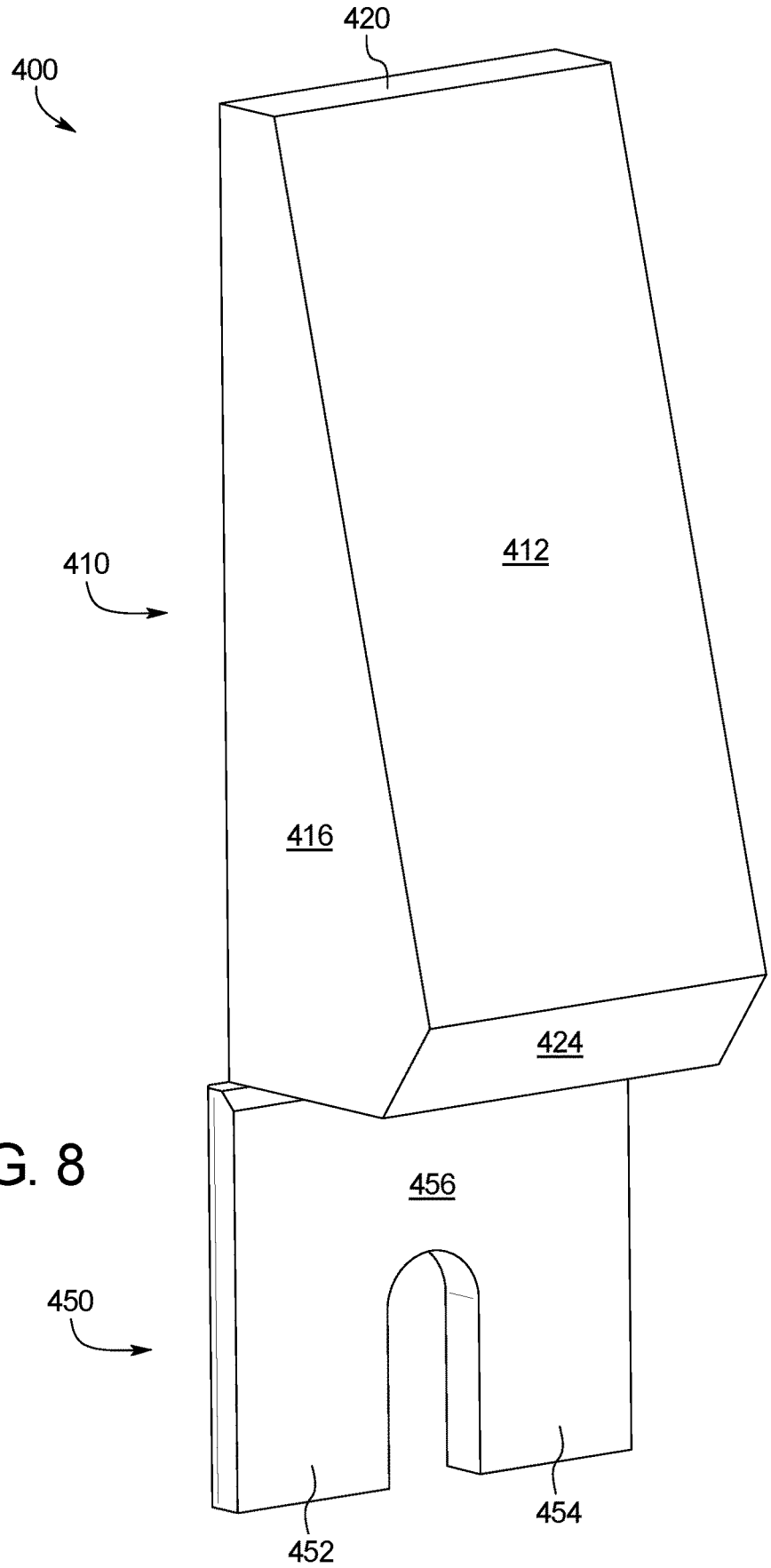
FIG. 8 is a further enlarged perspective interior view of one of the wedges of the deck connector assembly of FIG. 3.
Figure 9:
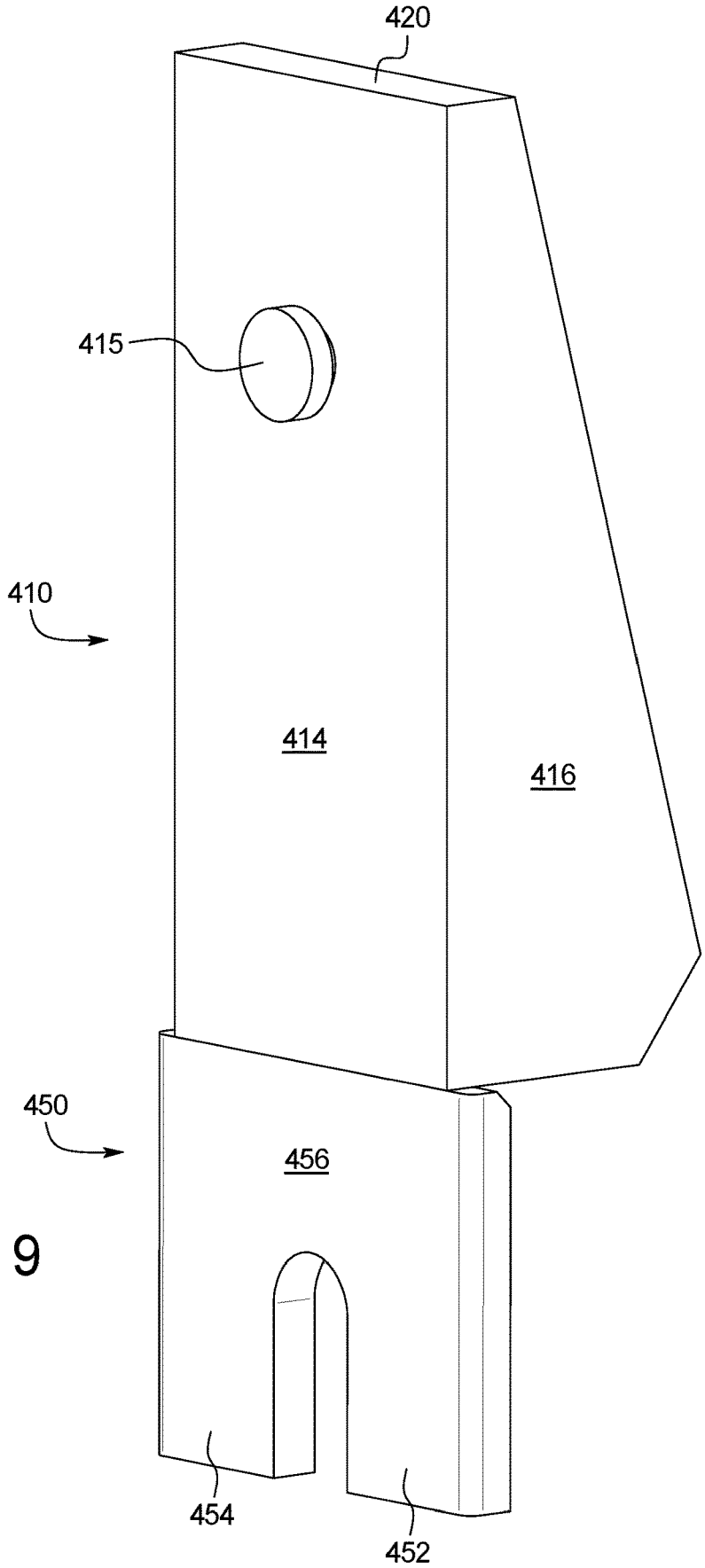
FIG. 9 is a further enlarged perspective exterior view of the wedge of FIG. 8.
Figure 10:
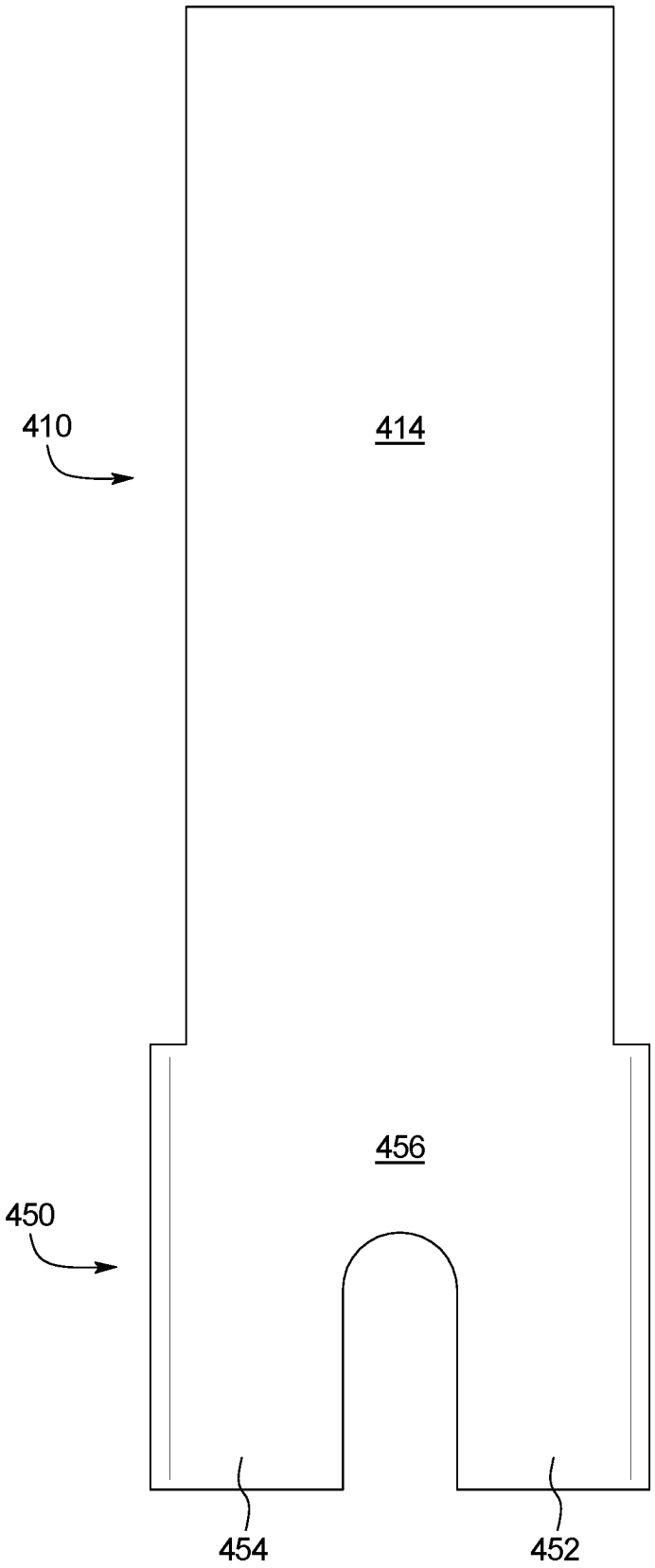
FIG. 10 is a further enlarged rear exterior view of the wedge of FIG. 8.
Figure 11:
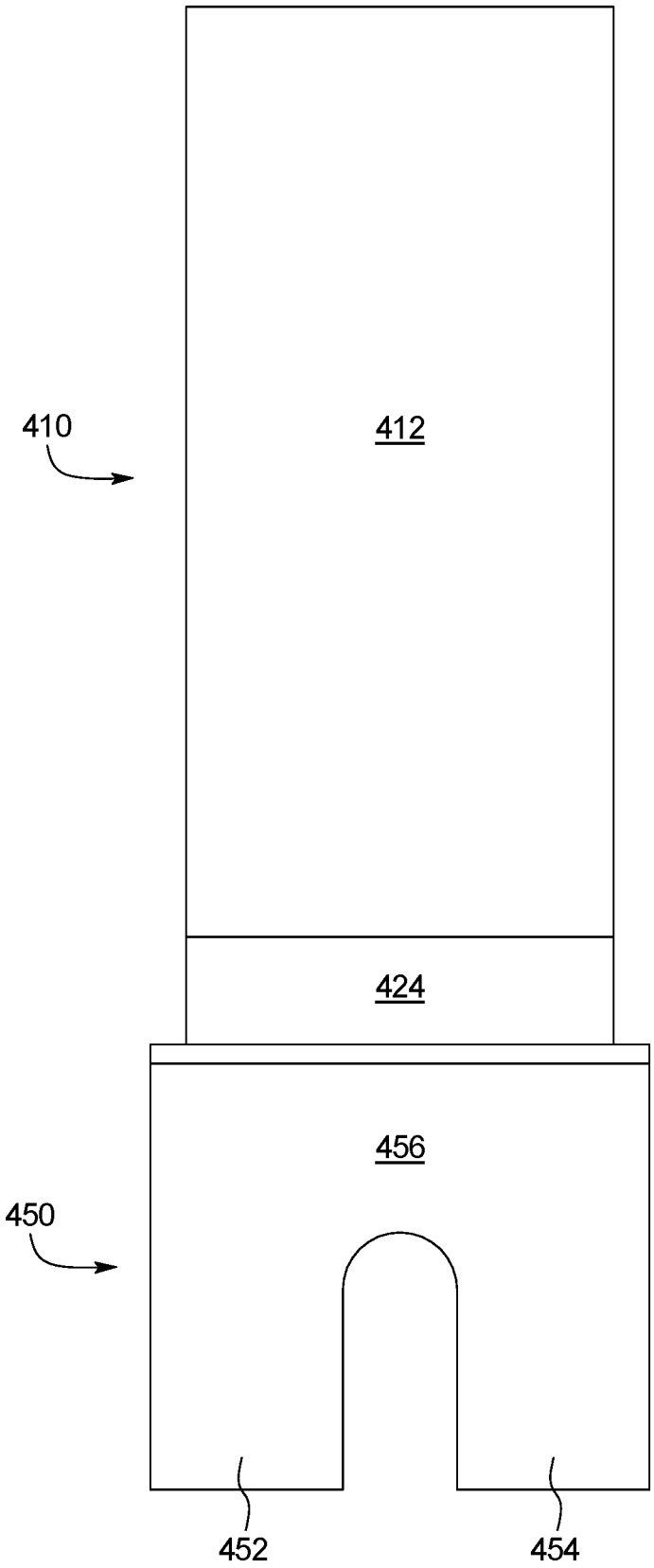
FIG. 11 is a further enlarged front interior view of the wedge of FIG. 8.
Figure 12:
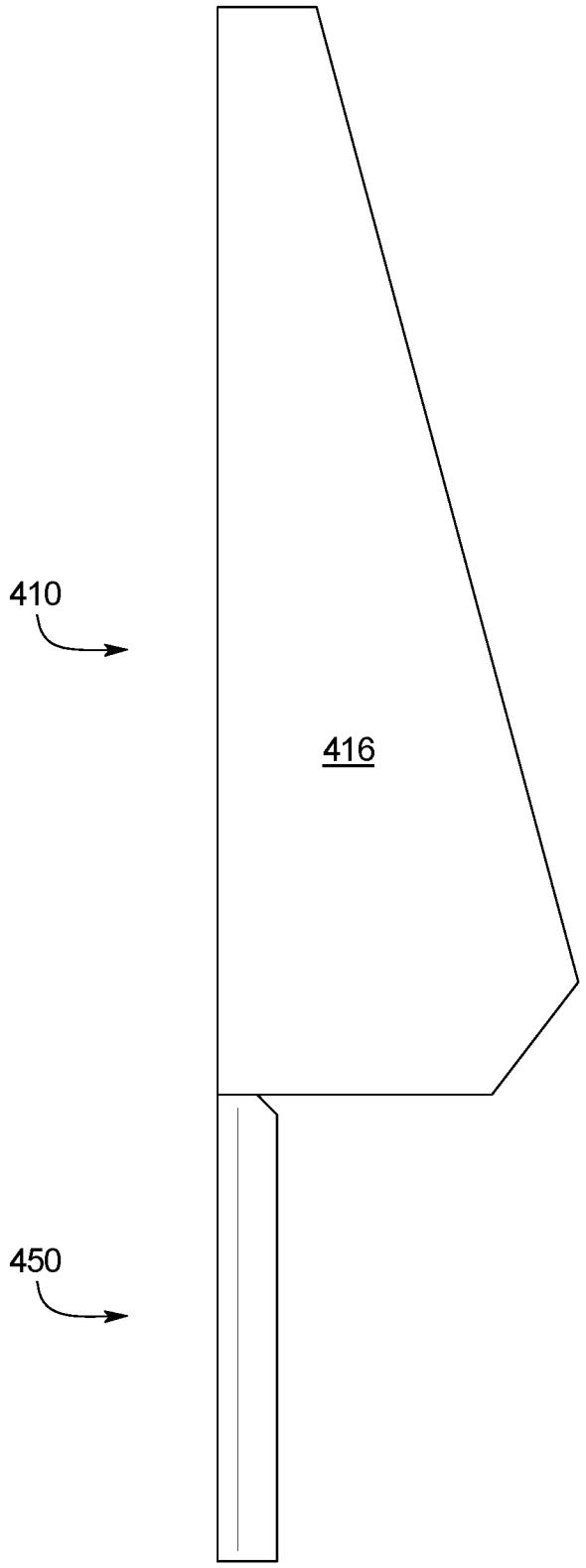
FIG. 12 is a further enlarged side interior view of the wedge of FIG. 8.
Figure 13:
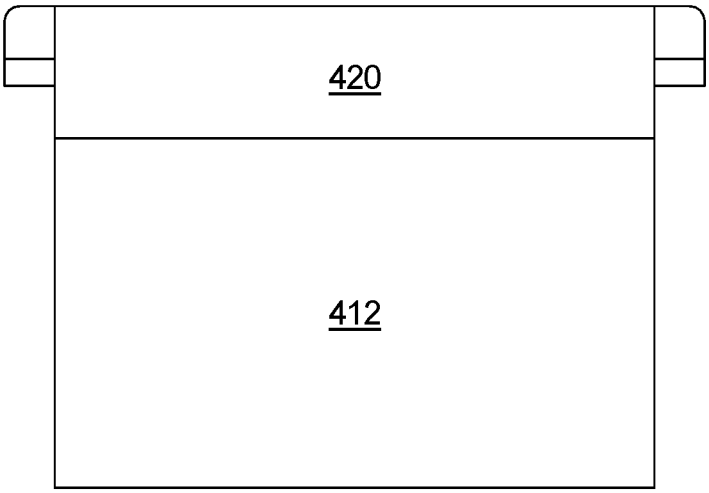
FIG. 13 is a further enlarged top view of the wedge of FIG. 8.
Figure 14:
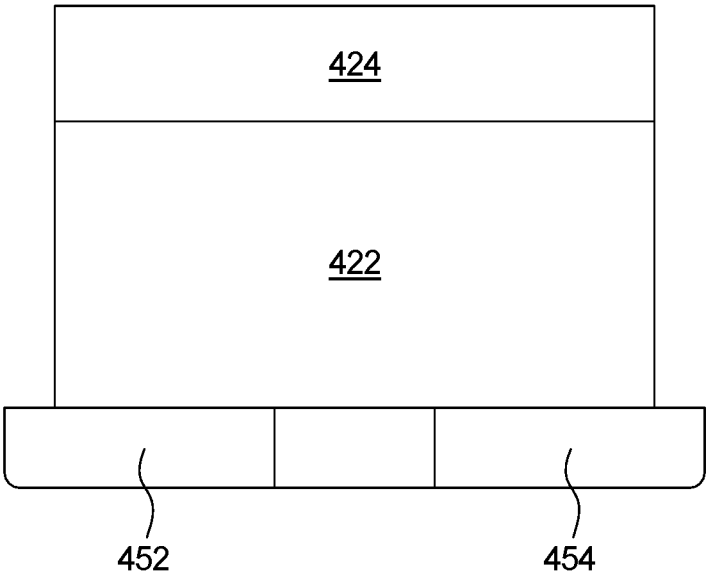
FIG. 14 is a further enlarged bottom view of the wedge of FIG. 8.

In this illustrated example embodiment, the wedge engagement bracket 110 defines a first plurality of bracket connection apertures 130*a*, 130*b*, and 130*c*, and a second plurality of bracket connection apertures 140*a*, 140*b*, and 140*c*. The first and second plurality of bracket connection apertures are spaced apart both from each other and within each set, as shown in FIGS. 3, 4, and 6. The first and second pluralities of bracket connection apertures are aligned with corresponding apertures on the first post clamping bracket 200 and the second post clamping bracket 300, discussed in further detail below. Each aperture of the first and second pluralities of bracket connection apertures is configured to receive a fastener such as a bolt.

In this illustrated example embodiment, the first post clamping bracket 200 includes: (1) a bracket connection plate 210, (2) a spacer plate 220, and (3) a flange engagement plate 230.

In this illustrated example embodiment, the bracket connection plate 210 is rectangular in shape. The bracket connection plate 210 defines a plurality of bracket connection apertures 212*a*, 212*b*, and 212*c*. The apertures 212*a*, 212*b*, and 212*c* align with apertures 130*a*, 130*b*, and 130*c* of the wedge engagement bracket 110. Apertures 212*a*, 212*b*, and 212*c* are each configured to receive a fastener, such that the first bracket 110 can be fixed to the bracket connection plate 210 via fasteners extending through the apertures.

In this illustrated example embodiment, the spacer plate 220 extends at 90 degree angle from bracket connection plate 210. The connection between the spacer plate 220 and the bracket connection plate 210 is curved. The spacer plate 220 is generally triangular in shape, having a narrower top edge and a wider bottom edge. A top internal angle of the generally triangular shaped spacer plate 220 can range from 5-45 degrees.

In this illustrated example embodiment, the flange engagement plate 230 extends at a 90 degree angle from the spacer plate 220. The connection between the flange engagement plate 230 and the spacer plate 220 is curved. The bracket connection plate 210, spacer plate 220, and flange engagement plate 230 are configured to form a "S", "Z", or other multi-direction shaped bracket when viewed from above, (but, can be other suitable shapes in accordance with the present disclosure). Further, the flange engagement plate 230 and the bracket connection plate 210 are angled with respect to each other by the top internal angle of the spacer plate 220 (e.g., between 5-45 degrees).

In this illustrated example embodiment, the second post clamping bracket 300 mirrors the first post clamping bracket 200. The second post clamping bracket 300 includes: (1) a bracket connection plate 310, (2) a spacer plate 320, and (3) a flange engagement plate 330.

In this illustrated example embodiment, the bracket connection plate 310 is rectangular in shape. The bracket connection plate 310 defines a plurality of bracket connection apertures 312*a*, 312*b*, and 312*c*. The apertures 312*a*, 312*b*, and 312*c* align with apertures 140*a*, 140*b*, and 140*c* of the wedge engagement bracket 110. Apertures 312*a*, 312*b*, and 312*c* are each configured to receive a fastener, such that the wedge engagement bracket 110 can be fixed to the bracket connection plate 310 via fasteners extending through the apertures.

In this illustrated example embodiment, the spacer plate 320 extends at 90 degree angle from the bracket connection plate 310. The connection between the spacer plate 320 and the bracket connection plate 310 is curved. The spacer plate 320 is generally triangular in shape, having a narrower top edge and a wider bottom edge. A top internal angle of the generally triangular shaped spacer plate 320 can range from 5-45 degrees.

In this illustrated example embodiment, the flange engagement plate 330 extends at a 90 degree angle from the spacer plate 320. The connection between the flange engagement plate 330 and the spacer plate 320 is curved. The bracket connection plate 310, spacer plate 320, and flange engagement plate 330 are configured to forma "S", "Z", or other multi-direction shaped bracket when viewed from above. Further, the flange engagement plate 330 and the bracket connection plate 310 are angled with respect to each other by the same top internal angle of the spacer plate 320 (e.g., between 5-45 degrees).

In this illustrated example embodiment, the first wedge 400 includes: (1) a block 410, (2) an alignment pin 415, and (3) a tab 450.

In this illustrated example embodiment, the block 410 includes a bracket engagement surface 412, a flange engagement surface 414, a first side surface 416, a second side surface (not shown), a top surface 420, a bottom surface 422, and a bottom angled surface 424.

In this illustrated example embodiment, the bracket engagement surface 412 is angled with respect to the flange engagement surface 414. The angle between the bracket engagement surface 412 and the flange engagement surface 414 can range from 5-45 degrees in various embodiments. The bracket engagement surface 412 is connected to the bottom surface 422 via the bottom angled surface 424. The bracket engagement surface 412 is rectangular in shape. The bracket engagement surface 412 is configured to contact and engage with the second side 114 of the wedge engagement bracket 110.

In this illustrated example embodiment, the flange engagement surface 414 is rectangular in shape. The flange engagement surface is configured to contact and engage with the first flange 72 of the upright post 28. The flange engagement surface 414 is connected to the top surface 420, the first side surface 416, the second side surface, and the bottom surface 422.

In this illustrated example embodiment, the first side surface 416 is tapered in shape, having a narrower top end and a wider bottom end. The first side surface 416 is connected to the bracket engagement surface 412, the flange engagement surface 414, the top surface 420, the bottom surface 422, and the bottom angled surface 424.

In this illustrated example embodiment, the second side surface (not shown) is tapered in shape, having a narrower top end and a wider bottom end. The second side surface is connected to the bracket engagement surface 412, the flange engagement surface 414, the top surface 420, the bottom surface 422, and the bottom angled surface 424. The second side surface is perpendicular to the first side surface 416.

In this illustrated example embodiment, the top surface 420 is rectangular in shape, and is connected to the bracket engagement surface 412, the flange engagement surface 414, the first side surface 416, and the second side surface.

In this illustrated example embodiment, the bottom surface 422 is rectangular in shape, and is connected to the bottom angled surface 424, the flange engagement surface 414, the first side surface 416, and the second side surface. The bottom surface 422 is perpendicular to the top surface 420.

In this illustrated example embodiment, the bottom angled surface 424 is rectangular in shape, and is connected to the bracket engagement surface 412, first side surface 416, the second side surface, and the bottom surface 422.

In this illustrated example embodiment, the alignment pin 415 extends outward from and perpendicular to the flange engagement surface 414. The alignment pin 415 is configured to fit into the plurality of wedge attachment apertures 76 of the first flange 72.

In this illustrated example embodiment, the tab 450 includes a first leg 452, a second leg 454, and a top portion 456 connecting the first leg 452 and the second leg 454. The tab 450 includes a curved connection between the first leg 452 and the second leg 454 via the top portion 456. An upper edge of the top portion 456 is connected to the block 410 of the wedge 400.

In this illustrated example embodiment, a width of the tab 450 is greater than a width of the block 410, such that a portion of the first leg 452, second leg 454, and top portion 456 extend beyond the edges of the block 410.

In this illustrated example embodiment, the tab 450 is positioned such that when the alignment pin 415 is inserted into a first wedge attachment aperture 76 of the first flange 72, the curved connection between the first leg 452 and the second leg 454 aligns with a second wedge attachment aperture 76 of the first flange 72. This enables a fastener to be inserted into the second wedge attachment aperture between the legs 452 and 454 to provide support to the tab 450 of the first wedge 400. The fastener inserted between the legs 452 and 454 prevents the wedge from rotating about the alignment pin 415 with respect to the upright post, ensuring that the top surface 420 remains on top. The tab is used to hold or secure the wedge in the correct position while the deck is being moved vertically.

In this illustrated example embodiment, the second wedge 500 is identical to the first wedge 400 and for brevity is not further described herein.

It should be appreciated from the above that in this illustrated example embodiment, the auto-rack car 10 can be manufactured by connecting the deck 50 to the upright posts 28, 28*a*, 28*b*, 28*c*, 28*d*, and 28*e* via the plurality of example deck connector assemblies 100, 100*a*, 100*b*, 100*c*, 100*d*, and 100*e*. Generally, this method includes, for each deck connector assembly: (1) attaching the wedge engagement bracket, the first post clamping bracket, and second post clamping bracket to the deck, and (2) attaching the wedges to the upright post. This method also generally includes thereafter lowering the deck such that the wedge engagement brackets engage the wedges attached to the upright posts and the post clamping brackets engage the outer flanges of the upright posts.

More specifically, various example embodiments of the present disclosure provide a method of manufacturing an auto-rack railroad car including: (1) attaching a plurality of upright posts to a railroad car frame, (2) attaching a plurality of wedges to the upright posts via respective alignment pins, (3) attaching wedge engagement brackets to a deck, (4) attaching first post clamping brackets to the wedge engagement brackets, (5) attaching second post clamping brackets to the wedge engagement brackets, and (6) lowering the deck such that the wedges are respectively disposed between the wedge engagement brackets and the post clamping brackets, and a second wedge is disposed between the wedge engagement bracket and the second post clamping bracket.

Various embodiments of this method include attaching the wedges to the interior surfaces of the flanges of upright posts. Alternatively, other embodiments of the method can include attaching the wedges to the exterior surfaces of the flanges of the upright posts. Still other examples can include attaching wedges to both the interior and exterior surfaces of the flanges of the upright posts.

Figures 15A, 15B, 15C:
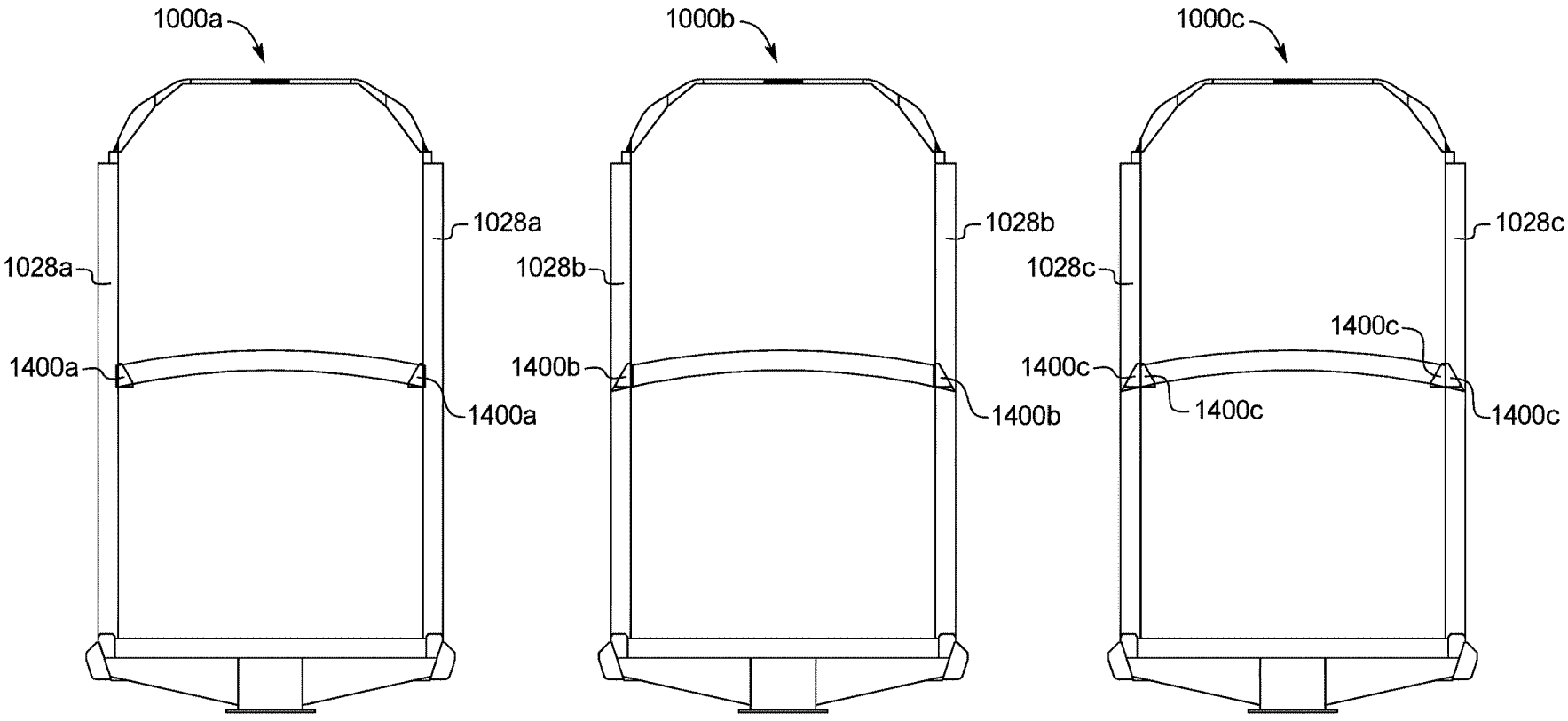
FIG. 15A is a diagrammatic end view of an example auto-rack railroad car including deck connector assemblies with wedges positioned interior to the upright posts.
FIG. 15B is a diagrammatic end view of example auto-rack railroad car including deck connector assemblies with wedges positioned exterior to the upright posts.
FIG. 15C is a diagrammatic end view of example auto-rack railroad car including deck connector assemblies with wedges positioned both interior and exterior to the upright posts.

FIG. 15A illustrates an end view of an example auto-rack railroad car 1000*a* having a plurality of wedges 1400*a* attached to the interior surfaces of the upright posts 1028*a*. The embodiment shown in FIG. 15A includes a plurality of deck connector assemblies (not shown) that operate as shown and described with reference to FIGS. 2-7, wherein the wedges are attached to the interior surfaces of the upright posts.

FIG. 15B illustrates an end view of an auto-rack railroad car 1000*b* having a plurality of wedges 1400*b* attached to the exterior surfaces of the upright posts 1028*b*. The embodiment shown in FIG. 15B includes a plurality of deck connector assemblies (not shown) that operate in a similar manner as is shown and described with reference to FIGS. 2-7. The deck connector assemblies included in the embodiment of FIG. 15B, however, include a wedge engagement bracket that is vertically disposed and engaged with the upright post 1028*b*, and first and second post clamping brackets that are in contact with the wedges 1400*b* on the exterior surfaces of the upright posts 1028*b*.

FIG. 15C illustrates an end view of an auto-rack railroad car 1000*c* having a plurality of wedges 1400*c* attached to both the interior surfaces and exterior surfaces of the upright posts 1028*c*. The embodiment shown in FIG. 15C includes a plurality of deck connector assemblies (not shown) that operate in a similar manner as is shown and described with reference to FIGS. 2-7. The deck connector assemblies included in the embodiment of FIG. 15C, however, include a wedge engagement bracket that is in contact with the wedges 1400*c* on the interior of the upright post 1028*c*, and first and second post clamping brackets that are in contact with the wedges 1400*c* on the exterior of the upright post 1028*c*.

Various embodiments of the present disclosure further include methods of modifying a height of a deck of an auto-rack car. Certain such embodiments include: (1) raising a deck connected to a plurality of deck connector assemblies, each deck connector assembly including a wedge engagement bracket, a first post clamping bracket, and a second post clamping bracket, (2) modifying the height at which the wedges attached to the upright posts are connected, wherein each wedge corresponds to one of the plurality of deck connector assemblies, and (3) lowering the deck onto the wedges such that the wedges are each disposed between a respective set of a wedge engagement bracket and the respective post clamping bracket(s).

Various embodiments of the present disclosure further include methods of modifying or converting an auto-rack railroad car from two to three decks. Certain such embodiments include: (1) modifying a height of a first deck, (2) modifying a height of a second deck, and (3) moving the first and second deck to quickly convert from a tri-level to a bi-level auto-rack car configuration.

Various embodiments of the present disclosure further include methods of modifying or converting an auto-rack railroad car from three to two decks, or from any first number of decks to any second number of decks. These examples can include steps of modifying the height of one or more decks, installing one or more decks, and/or removing one or more decks from the auto-rack railroad car.

Various embodiments of the present disclosure further include raising and/or lowering one or more decks, either during manufacturing of the auto-rack railroad car, in order to change the height of a deck, or to convert an auto-rack railroad car from a first number of decks to a second number of decks. In various such embodiments, a suitable mechanism (not shown) for raising or lowering one or more decks can be a separate mechanism from the auto-rack railroad car, or can be integrated with or a part of the auto-rack railroad car.

The example illustrated in the Figures includes a deck connector assembly 100 having a separate wedge engagement bracket 110, first post clamping bracket 200, and second post clamping bracket 300 that are connected via fasteners such as bolts. However, it should be appreciated that in alternative embodiments of the present disclosure the wedge engagement bracket 110, first post clamping bracket 200, and second post clamping bracket 300 are integrally (such as monolithically) formed such that they are a single piece, and no additional fasteners or other connecting mechanisms are needed.

The example illustrated in the Figures includes a deck connector assembly wherein the wedges 400 and 500 are connected to the post 28. However, it should be appreciated that in alternative embodiments of the present disclosure the wedges 400 and 500 are instead connected to the deck 50, and the wedge engagement bracket 110, first post clamping bracket 200, and second post clamping bracket 300 are connected to the upright post 28. In this case, the orientation of the various components may be reversed and/or flip upside down, such that the deck 50 attached to the wedge(s) is held in place by gravity in between the wedge engagement bracket 110, first post clamping bracket 200, and second post clamping bracket 300.

The example shown in the Figures includes the wedges 400 and 500 attached to the interior surfaces of the first flange 72 and the second flange 74 of the post 28. This is illustrated in FIG. 15A, and described above. It should be appreciated that alternative embodiments include attaching the wedges 400 and 500 to the exterior surfaces of the first flange 72 and the second flange 74. This embodiment is illustrated in FIG. 15B, and described above. In certain such alternative embodiments, the wedge engagement bracket 110 may be vertically disposed and engaged with the first flange 72 and the second flange 74. The first post clamping bracket 200 and the second post clamping bracket 300 may then be in contact with the wedges 400 and 500 on the exterior surfaces of the flanges 72 and 74.

Various other embodiments include first and second wedges attached to the interior surfaces of the flanges 72 and 74, as well as third and fourth wedges attached to the exterior surfaces of flanges 72 and 74. This embodiment is illustrated in FIG. 15C, and described above. The wedge engagement bracket 110 may be in contact with the first and second wedges, while the first clamping bracket is in contact with the third wedge on the outside of the flange 72, and the second clamping bracket is in contact with the fourth wedge.

Various components are described according to specific embodiments shown in the Figures. It should be appreciated that these components may have different shapes, orientations, and/or arrangements than those specifically shown. For example, the surfaces of the block 410 are described as being rectangular in shape, and it should be appreciated that other shaped surfaces may be used. In addition, the shapes of the three plates of each post clamping bracket may be different than those shown. Further, in some examples the post clamping brackets may extend from the deck itself, rather than being attached to the wedge engagement bracket as described herein. These examples are not an exhaustive list, and it should be appreciated that other components described herein may have different shapes, sizes, connections, and/or orientations while maintaining the same functionality as those shown in the figures.

It will be understood that modifications and variations may be effected without departing from the scope of the novel concepts of the present invention, and it is understood that this application is to be limited only by the scope of the claims.

The invention claimed is:

1. An auto-rack railroad car comprising:

a frame;

a plurality of upright posts supported by the frame;

a deck; and a plurality of deck connector assemblies connecting the deck to the upright posts, each deck connector assembly including:

a wedge connected to one of the upright posts, the wedge including a post engagement surface engaging said upright post and an opposing angled bracket engagement surface facing away from said upright post;

a wedge engagement bracket fixedly connected to the deck and engaging the angled bracket engagement surface of the wedge; and a post clamping bracket connected to the wedge engagement bracket and engaging said upright post.

2. The auto-rack railroad car of claim 1, wherein one of the upright posts includes a first flange engaged by the post clamping bracket of one of the deck connector assemblies.

3. The auto-rack railroad car of claim 1, wherein one of the upright post includes a first flange engaged by the post clamping bracket of one of the deck connector assemblies and a second flange engaged by the post clamping bracket of said deck connector assembly.

4. The auto-rack railroad car of claim 1, wherein the wedge engagement bracket of one of the plurality of deck connector assemblies defines a first plurality of apertures aligned with a corresponding second plurality of apertures of the post clamping bracket of that deck connector assembly.

5. The auto-rack railroad car of claim 1, wherein one of the deck connector assemblies includes a first post clamping bracket and a second post clamping bracket.

6. The auto-rack railroad car of claim 1, wherein one of the post-clamping brackets includes a bracket connection plate, a spacer plate, and a flange engagement plate.

7. The auto-rack railroad car of claim 6, wherein the spacer plate is substantially triangular.

8. The auto-rack railroad car of claim 7, wherein the bracket connection plate, the spacer plate, and the flange engagement plate form a multi-direction shaped bracket.

9. The auto-rack railroad car of claim 6, wherein a first plane defined by a surface of the bracket connection plate is angled with respect to a second plane defined by a surface of the flange engagement plate.

10. The auto-rack railroad car of claim 9, wherein the first plane is at an angle of from 5 to 45 degrees with respect to the second plane.

11. The auto-rack railroad car of claim 1, wherein one of the wedges includes an alignment pin extending from the flange engagement surface of the wedge.

12. The auto-rack railroad car of claim 1, wherein one of the wedges includes at least one alignment pin extending from a surface of the wedge.

13. The auto-rack railroad car of claim 1, wherein a first plane defined by the bracket engagement surface of one of the wedges is at an angle of from 5 to 45 degrees with respect to a second plane defined by the flange engagement surface of the wedge.

14. The auto-rack railroad car of claim 1, wherein one of the deck connector assemblies includes two wedges connected to an interior surface of one of the upright posts.

15. The auto-rack railroad car of claim 14, wherein each of said two wedges is connected to the interior surface of said upright post via an alignment pin extending from the flange engagement surface of the wedge through a wedge attachment aperture of one of a plurality of flanges of said upright post.

16. The auto-rack railroad car of claim 1, wherein one of the deck connector assemblies includes two wedges connected to an exterior surface of one of the upright posts.

17. The auto-rack railroad car of claim 1, wherein for one of the plurality of deck connector assemblies, the wedge engagement bracket of that deck connector assembly is connected by fasteners to the post clamping bracket of that deck connector assembly.

18. A method of creating an auto-rack railroad car comprising:

attaching a plurality of upright posts to a railroad car frame;

for a plurality of wedges each including a post engagement surface and an opposing angled bracket engagement surface, attaching the plurality of wedges to the upright posts such that for each wedge, the post engagement surface of the wedge engages the upright post to which the wedge is attached and the opposing angled bracket engagement surface of the wedge faces away from the upright post to which the wedge is attached;

fixedly attaching a plurality of wedge engagement brackets to a deck;

fixedly attaching a plurality of post clamping brackets to the wedge engagement brackets; and lowering the deck onto the railroad car frame such that the wedges are respectively disposed between the wedge engagement brackets and the post clamping brackets, such that the wedge engagement brackets engage the angled bracket engagement surfaces of the wedges, and such that the post clamping brackets engage the upright posts.

19. The method of claim 18, further comprising attaching the plurality of wedges to the upright posts such that for each wedge, the post engagement surface of the wedge engages an interior facing surface of the upright post to which said wedge is attached.

20. The method of claim 18, further comprising attaching the plurality of wedges to the upright posts such that for each wedge, the post engagement surface of the wedge engages an exterior facing surface of the upright post to which said wedge is attached.

21. The method of claim 18, further comprising attaching the plurality of wedges to the upright posts such that the post engagement surface of each of a first plurality of the wedges engages an exterior facing surface of the upright post to which said wedge is attached and such that the post engagement surface of each of a second plurality of the wedges engages an exterior facing surface of the upright post to which said wedge is attached.

22. The method of claim 18, further comprising for each of the plurality of wedges, attaching the wedge to the respective upright post via an alignment pin extending from a rear surface of the wedge through an aperture defined by said upright post.

23. An auto-rack railroad car comprising:

a frame;

a plurality of upright posts supported by the frame;

a deck; and a plurality of deck connector assemblies connecting the deck to the upright posts, each deck connector assembly including:

a wedge engagement bracket connected to the deck;

a post clamping bracket connected to the wedge engagement bracket; and a wedge connected to one of the upright posts, and wherein one of the post-clamping brackets includes a bracket connection plate, a substantially triangular spacer plate, and a flange engagement plate.

24. An auto-rack railroad car comprising:

a frame;

a plurality of upright posts supported by the frame;

a deck; and a plurality of deck connector assemblies connecting the deck to the upright posts, each deck connector assembly including:

a wedge engagement bracket connected to the deck;

a post clamping bracket connected to the wedge engagement bracket; and a wedge connected to one of the upright posts, and wherein one of the post-clamping brackets includes a bracket connection plate, a spacer plate, and a flange engagement plate, wherein a first plane defined by a surface of the bracket connection plate is angled with respect to a second plane defined by a surface of the flange engagement plate.

25. An auto-rack railroad car comprising:

a frame;

a plurality of upright posts supported by the frame;

a deck; and a plurality of deck connector assemblies connecting the deck to the upright posts, each deck connector assembly including:

a wedge engagement bracket connected to the deck;

a post clamping bracket connected to the wedge engagement bracket; and a wedge connected to one of the upright posts, and wherein one of the deck connector assemblies includes two wedges connected to an interior surface of one of the upright posts of the upright posts, wherein each said wedge is connected to the interior surface of said upright post via an alignment pin extending from a flange engagement surface of the wedge through a wedge attachment aperture of one of a plurality of flanges of said upright post.

* * * * *